US010434430B2

(12) United States Patent
Mahanes

(10) Patent No.: US 10,434,430 B2
(45) Date of Patent: Oct. 8, 2019

(54) REMOTE CONTROL BOAT POOL RACE COURSE FLOAT SYSTEM AND METHOD

(71) Applicant: Justin Mahanes, Tampa, FL (US)

(72) Inventor: Justin Mahanes, Tampa, FL (US)

( * ) Notice: Subject to any disclaimer, the term of this patent is extended or adjusted under 35 U.S.C. 154(b) by 0 days.

(21) Appl. No.: 15/796,809

(22) Filed: Oct. 29, 2017

(65) Prior Publication Data

US 2019/0126159 A1 May 2, 2019

(51) Int. Cl.

| | |
|---|---|
| ***A63H 23/16*** | (2006.01) |
| ***A63H 23/00*** | (2006.01) |
| ***A63H 23/02*** | (2006.01) |
| ***A63H 23/10*** | (2006.01) |
| ***A63H 18/02*** | (2006.01) |
| ***A63K 1/00*** | (2006.01) |
| *A63H 30/04* | (2006.01) |

(52) U.S. Cl.

CPC ..... *A63H 23/10* (2013.01); *A63H 18/021* (2013.01); *A63H 18/026* (2013.01); *A63H 23/005* (2013.01); *A63H 23/16* (2013.01); *A63K 1/00* (2013.01); *A63H 23/02* (2013.01); *A63H 30/04* (2013.01)

(58) Field of Classification Search

CPC ..... A63H 23/00; A63H 23/005; A63H 23/02; A63H 23/16; A63H 23/10; A63H 18/021; A63H 18/026; A63K 1/00

See application file for complete search history.

(56) References Cited

U.S. PATENT DOCUMENTS

| | | | | | |
|---|---|---|---|---|---|
| 2,245,267 | A * | 6/1941 | Elfstrand | A01M 31/06 | 43/3 |
| 3,014,723 | A * | 12/1961 | Butler | A63B 67/007 | 273/350 |
| 3,895,801 | A * | 7/1975 | Baird | A63B 63/00 | 273/350 |
| 5,615,881 | A * | 4/1997 | Potter | A63F 9/305 | 273/140 |
| 5,941,586 | A * | 8/1999 | Fann | E04H 4/1609 | 294/104 |
| 6,554,677 | B2 * | 4/2003 | Leemon | A63H 33/008 | 446/122 |
| 7,364,487 | B2 * | 4/2008 | Evans | A63H 33/008 | 446/108 |
| 8,403,723 | B1 * | 3/2013 | Haner | A63H 33/08 | 446/120 |
| 9,821,241 | B2 * | 11/2017 | Haner | A63H 33/08 | |
| 2003/0049983 | A1 * | 3/2003 | Beretich, Jr. | A63B 69/0093 | 441/129 |

(Continued)

*Primary Examiner* — Eugene L Kim
*Assistant Examiner* — Alyssa M Hylinski
(74) *Attorney, Agent, or Firm* — Justin Luby

(57) ABSTRACT

The present disclosure pertains to a race course system for remote controlled boat racing where the outer boundary of the race course is comprised of the exterior walls of a swimming pool enclosure and the internals walls of the race course is comprised of floating devices with connection point for interconnecting the floats and an anchoring device and adjustable length anchor tether attached to the bottom of a number of the floating devices. The floating devices can be attached to each other in various configurations to create various different race course layouts, such as an oval course, a figure "eight" course, or even an intricate "road course" configurations.

7 Claims, 7 Drawing Sheets

(56) References Cited

U.S. PATENT DOCUMENTS

| | | | | |
|---|---|---|---|---|
| 2004/0063380 | A1* | 4/2004 | Chi | A63H 33/046<br>446/220 |
| 2010/0056013 | A1* | 3/2010 | Kaplan | A63H 33/046<br>446/92 |
| 2013/0324003 | A1* | 12/2013 | Hippely | A63H 18/02<br>446/153 |
| 2015/0336639 | A1* | 11/2015 | Pennington | B63B 21/29<br>114/294 |

* cited by examiner

REMOTE CONTROL BOAT POOL RACE COURSE FLOAT SYSTEM AND METHOD

CROSS-REFERENCE TO RELATED APPLICATIONS

Not Application

FIELD OF THE INVENTION

The present invention pertains to pool race tracks for racing Remote Control Boats, more particularly a RC Boat race track where the external boundaries of the race track are formed by the exterior walls of a pool and the internal boundaries of the racetrack are formed by a plurality of floating structures that can bet attached and detached to each other in order to allow for simple reconfiguration of the internal boundaries of the racetrack.

BACKGROUND

Racing remote control boats is a popular hobby for individuals of all ages. Race courses for remote control boat racing are traditionally constructed of shallow inflatable pools where the course configuration is formed into the pool or the fixedly attached to the pool at specified anchor point or the race course boundaries can be formed into professionally manufactured boat racing structures.

Remote control race courses formed in the pre-manufactured inflatable pools are typically small, designed for younger children and not conducive to racing larger and faster boats. Larger professionally manufactured boat courses are typically not suitable for home use, due to their large size and cost to construct.

Many homes are equipped a pool already have an ideal body of water where a large scale remote control race course could be constructed.

Thus, there exists a need for an apparatus, or plurality of apparatuses which can be utilized to simply convert an existing body of water, such as a swimming pool, into a race course for remote control boat racing.

SUMMARY

The present disclosure pertains to a race course system for remote controlled boat racing. In one embodiment the outer boundary of the race course is comprised of the exterior walls of a swimming pool enclosure, either in-ground or above-ground. The internals walls of the race course are comprised of a plurality floating devices with an anchoring device and adjustable length anchor tether attached to the bottom of a number of the floating devices. Each of the floating devices comprises at least one device to allow the floating devices to be connected and disconnected to each other.

The floating devices can be attached to each other in various configurations to create various different race course layouts, such as an oval course, a figure "eight" course, or even an intricate "road course" configurations. To create these courses, not all floating devices are required to have an anchoring device attached. In one instance where five or six floating devices are attached to each other to create a straight alley for the boats to travel, it may be that having anchors attached to the end pieces is sufficient to create the internal wall structure for the alley.

The floating devices can be manufactured in a plurality of shapes which can be connected to form a race course configuration. Additionally, any number of connection means can be used to allow the floating devices to be connected and disconnected to each other.

In one embodiment, the method of constructing a race course system has the steps of providing an enclosed body of water having an wall structure which entraps water inside the structure, such as a swimming pool, and a plurality of floating devices with at least one attachment member and a least one anchoring device connected to at least one of the floating devices, strategically locating the floating devices with anchors within the enclosed body of water to create the desired course shape and attaching additional floating devices to the anchored floating devices using the attachment members, as needed, to complete the desired inner boundaries for the race course within the confines of the wall structure.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
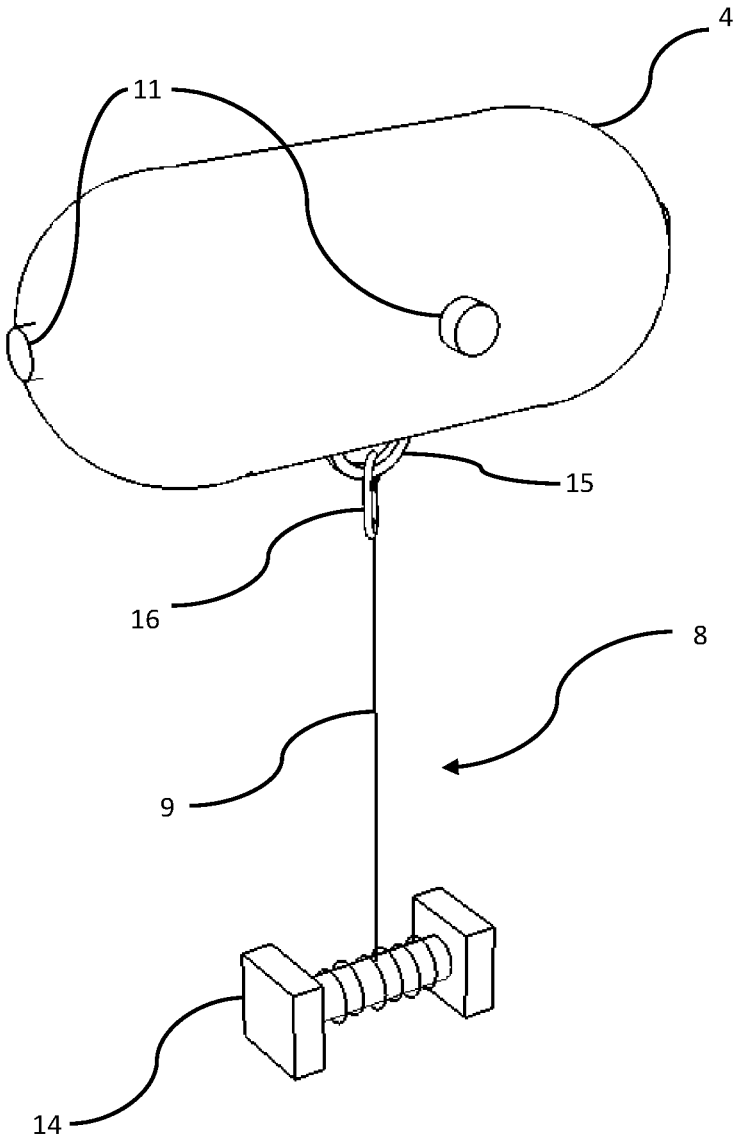
FIG. 1 illustrates a perspective view drawing of the first embodiment of the floating device of the current invention, capsule shaped with magnetic attachment members with an anchor device attached to the bottom when anchored to the bottom of a sloped pool.

The present invention provides for a race course system for remote control boat 1 racing. The race course system provides for a fixed external boundary 2 which is comprised of the external wall of a large tank structure 3 which is filled with water, such as a swimming pool. The tank structure can have either a fixed depth, or a variable depth, such as a swimming pool with a shallow end and a deep end. Inside the fixed external boundary of the large tank structure, a plurality of floating devices 4 are arranged and connected to each other to form inner boundary structures 5 which can form channels for the race course configuration.

The floating devices 4 of the current invention can be various three dimensional shapes, for example, without limitation capsules, spheres, tubes, cubes, and the like. Each of the floating devices 4 will comprise at least one attachment member 7 which allows the floating device 4 to attach to other floating devices 4. A plurality of the floating devices 4 are arranged and connected to each other using the attachment members 7 to create an inner boundary structure 5.

Attached to each inner boundary structure 5 is at least one anchoring device 8. The anchoring device(s) 8 are attached to the inner boundary structure 5 and have a weighted end 10 which rests on the floor of the tank structure 3. Additionally, the anchor devices 8 have an adjustable length tether 9 connecting the anchor to the floating device 4 in order to ensure the inner boundary structure 5 is maintained at its proper position. Tether 9 length is adjustable to allow for the anchoring device 8 to function in tank structures 3 with variable depths, like many swimming pools which have shallow ends and deep ends.

Figure 2:
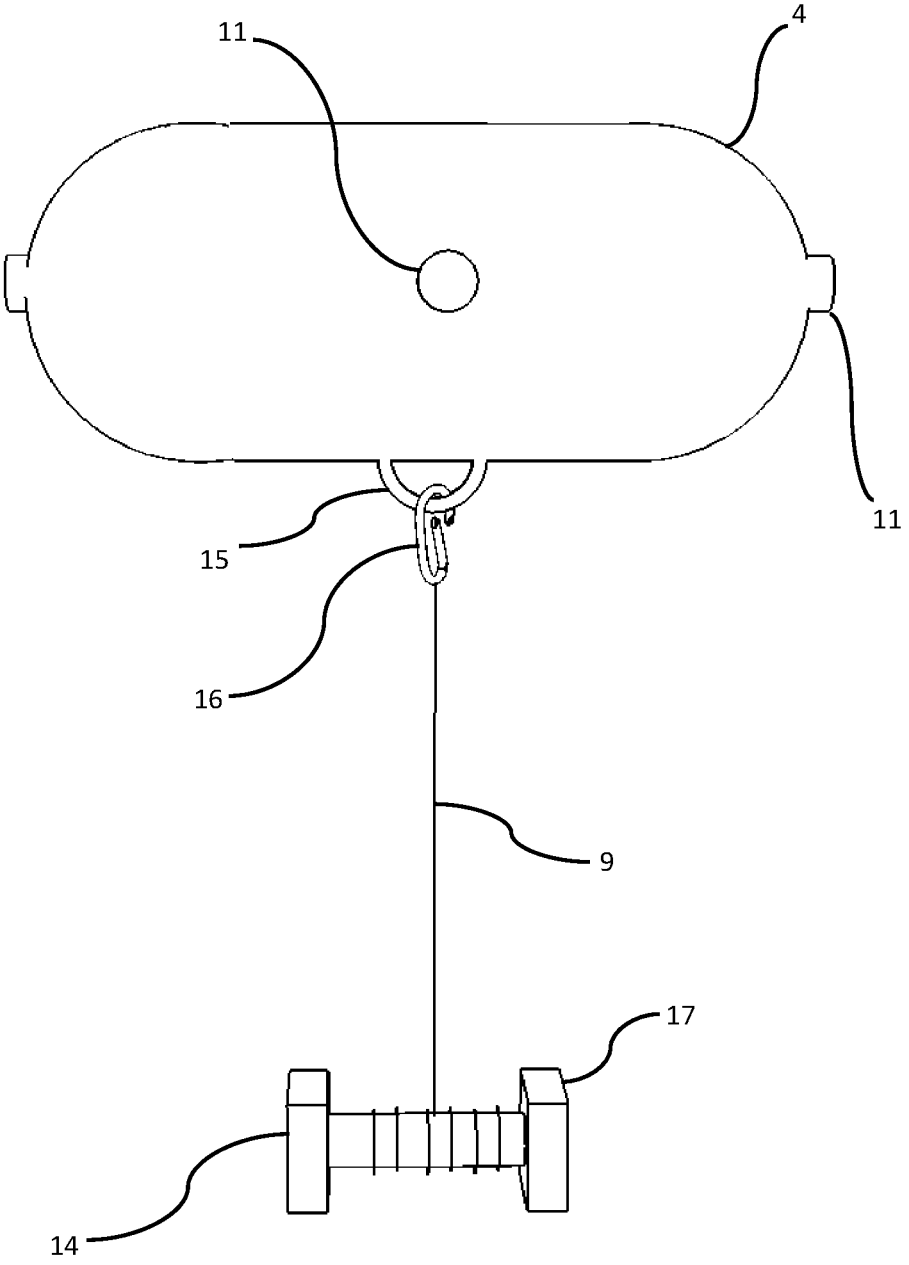
FIG. 2 illustrates a side view drawing of the first embodiment of the floating device of the current invention, capsule shaped with magnetic attachment members with an anchor attached.

FIGS. 1 & 2 depict the first embodiment of the floating devices 4 of current invention. Referring to FIGS. 1 & 2, the floating devices 4 are a capsule shaped, three dimensional structures. Affixed to the capsule shaped structure at the front, back, and sides are attachment members 7 in the form of magnets 11. The use of magnets 11 as attachment members are ideal, because the magnets 11 can be simply attached and detached from each other requiring minimal effort connect and disconnect floating devices 4 to each other. The ability to connect and disconnect floating devices 4 the using only magnets 11 allows the users to position and reposition the floating devices 4 in the tank structure 3 using devices that are commonly available at a swimming pool, such as a pool brush or pool skimmer. Being able to utilize these tools to position and reposition the floating devices 4 is ideal because this method does not require the user to get into the pool and get wet to locate the floating devices 4 at the desired locations.

Figure 3:
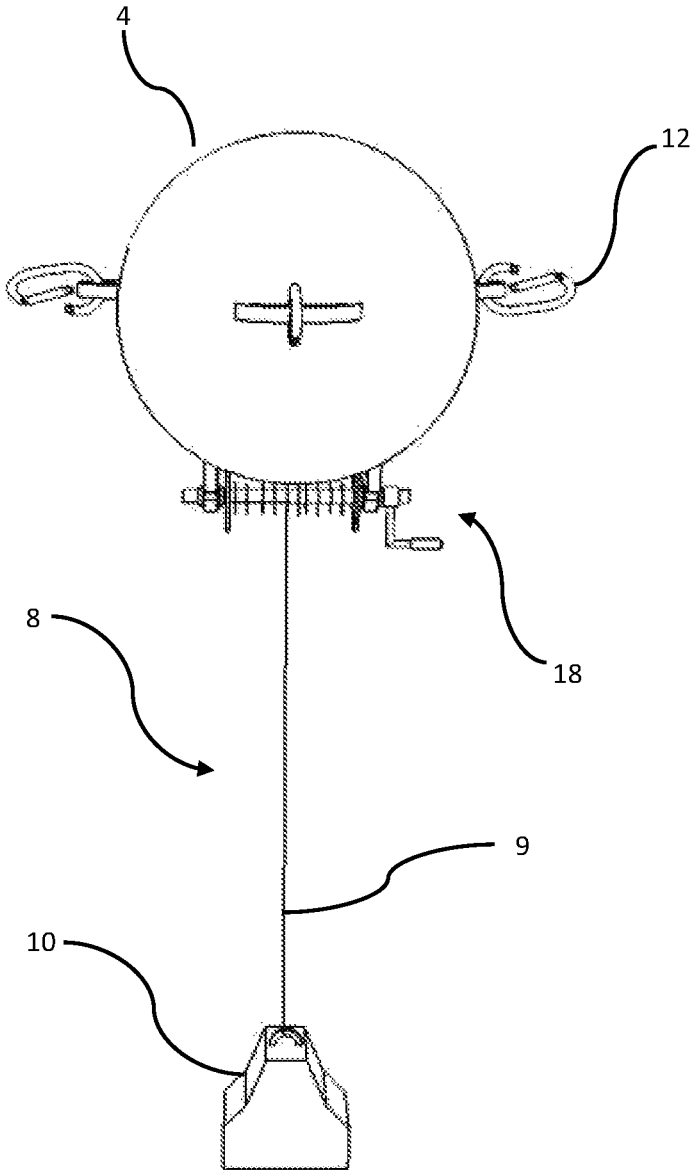
FIG. 3 illustrates a side view drawing of the second embodiment of the floating device of the current invention, sphere shaped with carabiner attachment members with an reeled anchor system attached.

FIG. 3 depicts a first alternate embodiment of the floating devices 4 of current invention. Referring to FIG. 3, the floating devices 4 are a spherical shaped, three dimensional structures. Affixed to the spherical shaped structure at the front, back, and sides of the are attachment members 7 in the form of clips 12. While not the preferred embodiment of the attachment members, the clips 12 are acceptable medium to connect the floating devices 4 to each other. The upside of the use of clips 12 is that they are simply replaced if they become damaged, whereas replacement of magnets 11 may be a bit more difficult. However, connecting and disconnecting floating devices 4 which use clips 12 as attachment members 7 would not be feasible using devices that are commonly available at a swimming pool, such as a pool brush or pool skimmer.

Figure 4:
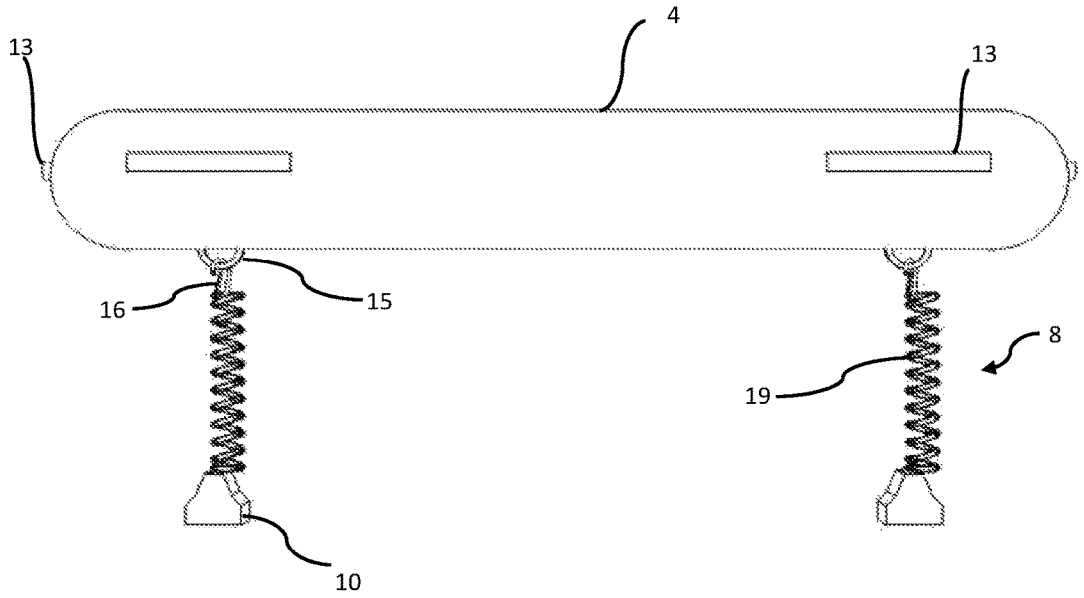
FIG. 4 illustrates a side view drawing of the third embodiment of the floating device of the current invention, tube shaped with hook and loop fastener attachment members with an anchor attached.

FIG. 4 depicts a second alternate embodiment of the floating devices 4 of current invention. Referring to FIG. 3, the floating devices 4 are a tubular shaped, three dimensional structures. Affixed to the tubular shaped structure at the front, back, and sides of the attachment members in the form of hook and loop fasteners 13. The attachment members 7 are self-engaging hook and loop fasteners 13 with hook and loop woven on the same surface. Utilizing self-engaging hook and loop fastener 13 woven on the same surface eliminates the need to organize the attachment members 7 when attaching floatation devices 4 together so that there is a hook and loop fastener 13 piece with a hook side and a matching loop side on the other attachment member 7 to ensure there is engagement. Similar to using magnets 11 as attachment members 4, use of hook and loop fastener 13 allows users to reposition the floating devices 4 in the tank structure 3 using devices that are commonly available at a swimming pool, such as a pool brush or pool skimmer. Being able to utilize these tools to position and reposition the floats is idea because this method does not require the user to get into the pool and get wet to locate the floating devices 4 at the desired locations.

FIGS. 1 and 2 depict a first embodiment of the anchoring device 8. The anchoring device 8 is used to fix the location of one or more floating devices 4 within the large tank structure 3. In the first embodiment the anchoring device 8 comprises a tether 10 and a weighted spool piece 14. The weighted spool piece 14 is barbell shaped and the lower end of the tether 9 is affixed to the weighted spool piece 14. The other end of the tether is attached to an anchoring point 15 on the underside of the floatation device 4 via a clip 16 located on the upper end of the tether 9. Additionally, the weighted spool piece 14 has at least one flat side 17, so that the weighted spool piece 14 does not roll along the bottom of the tank structure 3.

Attaching the tether 9 to the floating device 4 via an anchoring point 15 and clip 16 is the preferred method of attaching the tether 9 to the floating device 4 due to the ability to simply attach and detach the tether 9 from the floating device 4, making it simpler to create variations for the inner boundary structures 5. While this is the preferred methodology for connecting the tether 9 to the floatation device 4, there are a number of acceptable methods to achieve this result, including but not limited to tying the tether 9 to and anchoring point 15 on the floating device 4 or using an adhesive to glue the tether 9 to the floating device 4.

Referring to FIGS. 1 and 2, the first embodiment of the anchoring device 8 is used by attaching the clip 16 to an anchor point 15 on the floating device 4, and wrapping the tether around the weighted spool piece 14. Standing from the side of the tank structure 3 the user can us a pool brush to position the floating device 4 in the large tank structure 3. Once the floating device 4 is in the desired position, the user will throw the wound weighted spool piece 14 and tether 9 into the water near the floatation device 4. Once in the water, the weighted spool piece 14 will sink to the bottom and unwind the tether 9 from the weighted spool piece 14 as it sinks to the bottom. Once the weighted spool piece 14 has reached the bottom of the tanks structure 3, the tether 9 will stop unwinding, and the floatation device 4 will be held in place. The embodiment of the anchoring device 8 has two ideal features, one, again, it allows the user to arrange the floating devices 4 without needing to get into the pool, and also, it automatically adjusts for different pool depths as the anchoring device 8 sinks and unwinds.

Referring to FIG. 3, a second embodiment of the anchoring device 8 is created used by attaching a spool and reel device 18 to the underside of a floating device 4. Attached to and wrapped around the spool and reel 18 is a tether 9, which has a weight 10 attached to the lower end of the tether 9. The spool and reel 18 is equipped with a braking system that will keep the tether 9 and spool and reel 18 in the wound position until such point when the user wants to unwind the tether 9 and lower the weight 10 to fix the location of the floatation device 4. When locating the floatation device 4 in the large tank structure 3 the user will move the device to its desired location, and release the brake on the spool and reel 18, allowing the tether 9 to unwind from the spool and reel 18 and the weight 10 will fall to the bottom of the large tank structure 3. Once the weight 10 has reached the bottom of the large tank structure 3, the user will re-engage the brake, ensuring the spool and reel 18 does not continue to unwind, preventing the floating device 4 from drifting from its location. While effective in anchoring the floatation device 4 in its location, this embodiment of the anchoring device 8 will require the user to get into the large tank structure to locate the floatation device 4.

Referring to FIG. 4, a third embodiment of the anchoring device 8 created used and elastic coil tether 19 and weight 10. The elastic coil tether 19 is attached to the anchoring point 15 on the underside of the floatation device 4 via a clip 16. Standing from the side of the tank structure 3 the user can us a pool brush to position the floating device 4 in the large tank structure 3. Once the floating device 4 is in the desired position, the user will throw the weight 10 and wound elastic coil 19 into the water near the floatation device 4. Once in the water, the weight 10 will sink to the bottom and expand the wound elastic coil 19 as it sinks to the bottom of the pool. Once the weight 10 has reached the bottom of the pool, the elastic tether 19 will stop expanding, and the elastic nature of the coil will hold the floatation device 4 in place. The embodiment of the anchoring device 8 has two ideal features, one, again, it allows the user to arrange the floating devices 4 without needing to get into the pool, and also, it automatically adjusts for different pool depths as the weight 10 sinks and uncoils.

The floating devices 4 can be constructed of a number of materials to achieve the desired effect. The only requirement for the materials of construction is that resulting structure be buoyant. In one embodiment the floating device 4 is an inflatable structure consisting of one or more air chambers, which are hollow enclosures bound by a soft and flexible airtight material (e.g. vinyl), which a gas can enter into or leave from through valves. The benefit of constructing the floating device 4 of an inflatable structure is that the device could be packaged in smaller containers for sale, and can be deflated for simpler storage. The potentially detrimental effects of using this technology is that the device can be damaged by puncturing the device, and some users may prefer not to inflate and deflate the device. In a second embodiment the floating device 4 is constructed of a solid material with air pockets which floats on water, such as a polyethylene foam. The benefit of constructing the floating device of an polystyrene foam is that the device is more robust and less susceptible to damage. The potentially detrimental effects of using this technology is that the devices will be larger, more expensive to construct, package, ship and sell. Both of these forms of constructing a floatation device 4, as well as many other forms of constructing floating devices 4, are well known to those skilled in the art.

Figure 5:
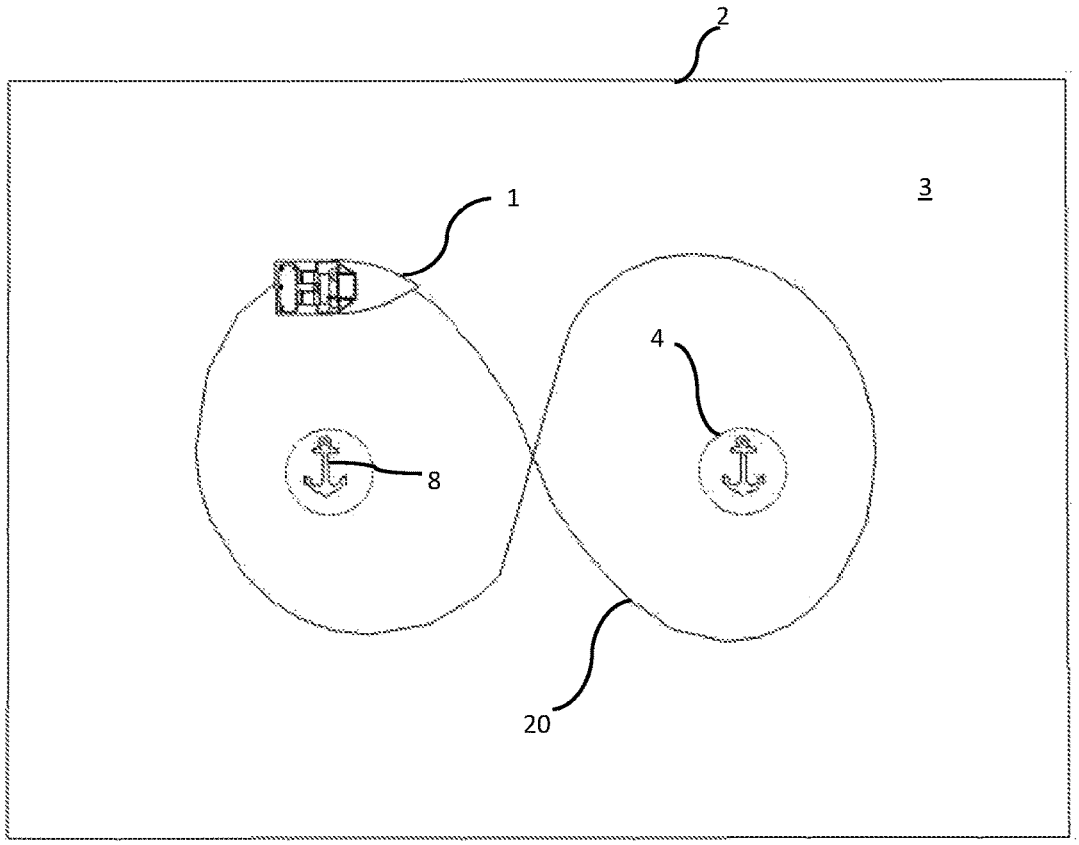
FIG. 5 illustrates a schematic depicting how the floating devices, and anchor devices, could be arranged in a swimming pool enclosure to create a "figure eight" race course configuration.

Referring to FIG. 5, in one embodiment of the invention, two embodiments of the current device which are spherical floating devices 4 are placed centered within in a large tank structure 3, separated from each other by an acceptable distance, and anchored in place to create a "figure eight" race course channel 20 for remote controlled boats 1. Once anchored in place, using any one of the three embodiments of anchor devices 8 discussed above, the floating devices 4 will remain stationary in their desired locations, even as the remote controlled boats 1 create wakes which would relocate and un-anchored floating device 4 within the large tank structure 3.

Figure 6:
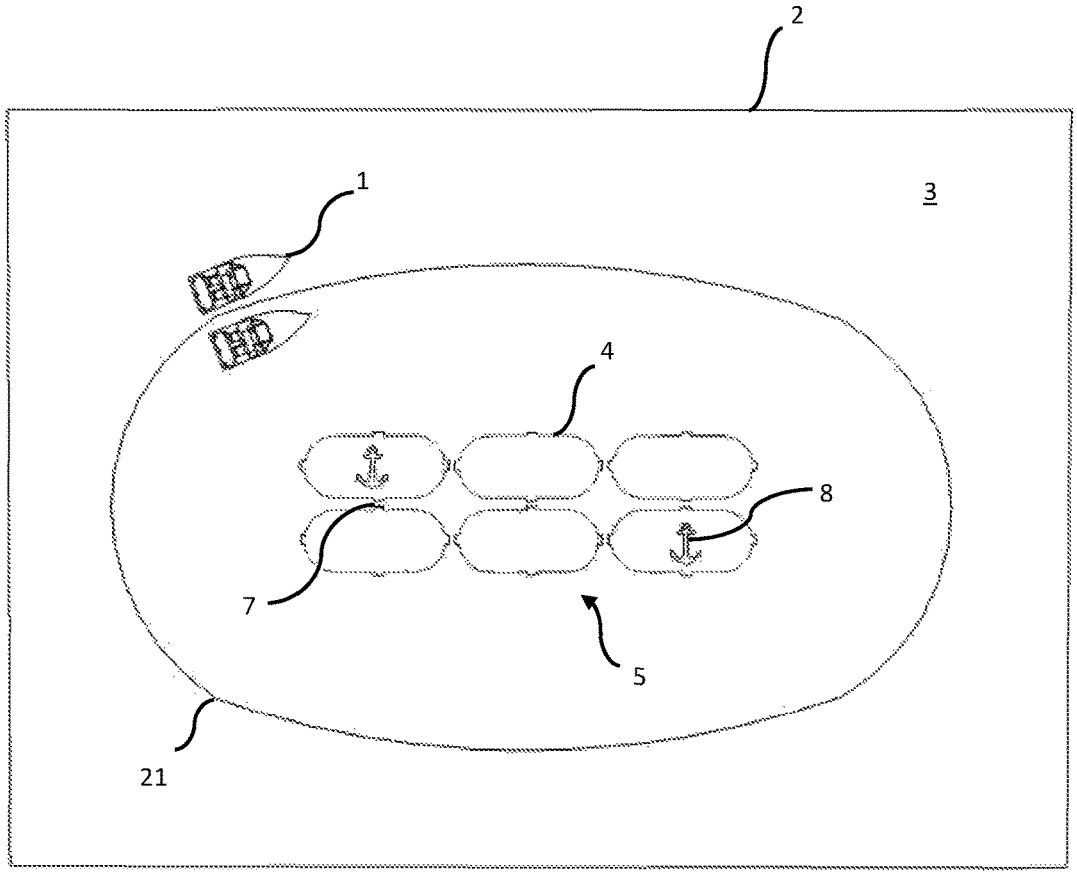
FIG. 6 illustrates a schematic depicting how the floating devices, and anchor devices, could be arranged in a swimming pool enclosure to create an "oval" race course configuration.

Referring to FIG. 6, in a second embodiment of the invention, six embodiments of the floating devices 4, which are capsule shaped floating structures 4, are connected to each other, using attachment members 7 comprising magnets, clips, hook and loop fastener or any other means known to those skilled in the art to form a rectangular shaped inner boundary structure 5, which is then centered within in a large tank structure 3, to create an "oval" race course channel 21 for remote controlled boats 1. Anchor devices 8 are then strategically connected a number of the floating devices 4 used to for the inner boundary structure 5 at locations where the anchor devices 8 hold the inner boundary structure 5 stationary in its desired location, even as the remote controlled boats 1 create wakes which would relocate and un-anchored inner boundary 5 within the large tank structure 3. By interconnecting the floating devices 4, the inner boundary structure 5 can be anchored by using only two anchor devices 8, whereas, had the floating devices 4 not been interconnected, each individual floating device 4 would require is own anchor device 8.

Figure 7:
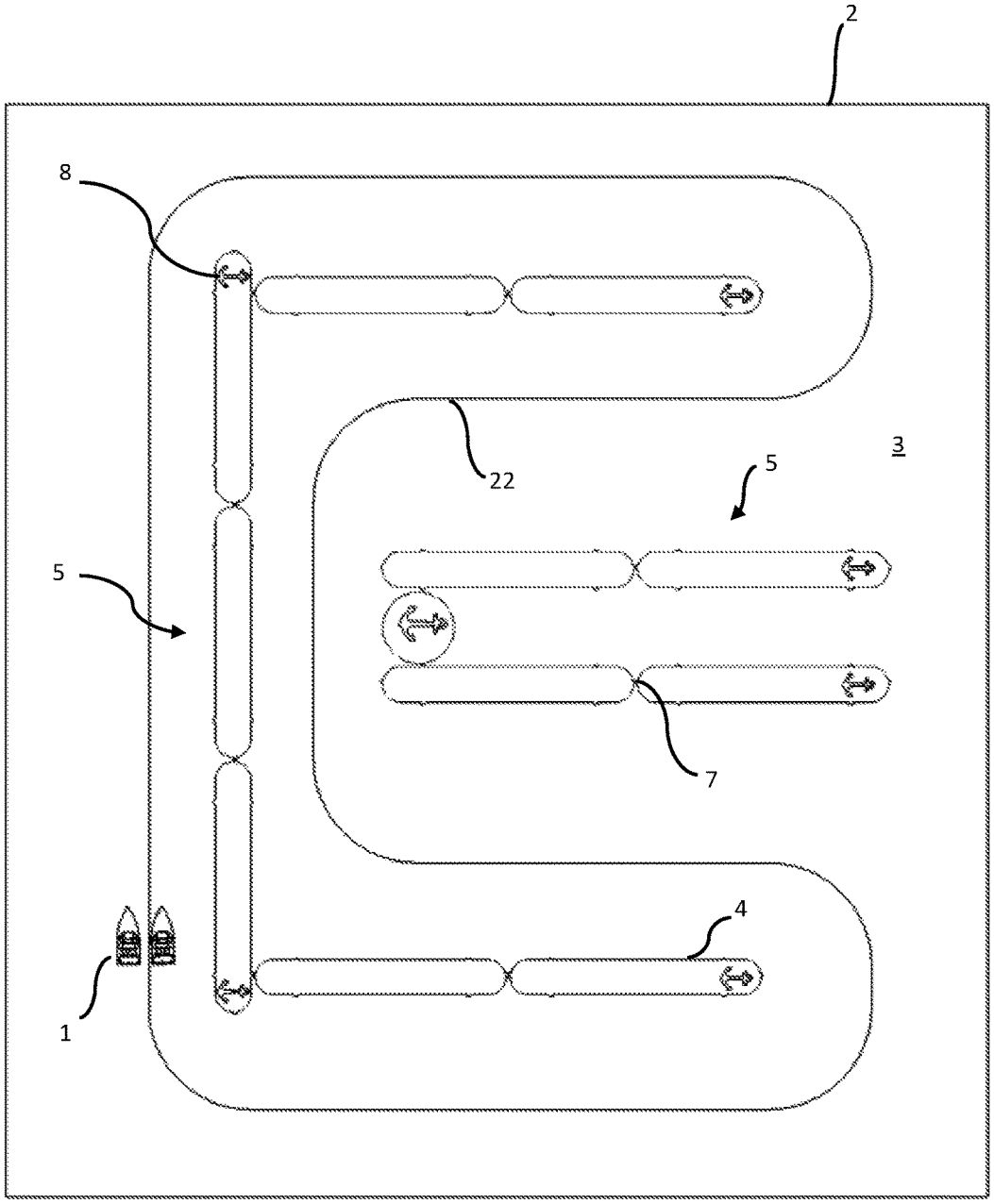
FIG. 7 illustrates a schematic depicting how the floating devices, and anchor devices, could be arranged in a swimming pool enclosure to create an "road course" race course configuration.

Referring to FIG. 7, in a third embodiment of the invention, a plurality of the floating devices 4, which are a variety floating structure shapes, are connected to each other, using attachment members 7 comprising magnets, clips, hook and loop fastener or any other means known to those skilled in the art to form a several complex shaped inner boundary structures 5, which are then located within in a large tank structure 3, to create channels for the remote control boats 1 to travel through, creating a "road course" race course channel 22 for remote controlled boats 1. Anchor devices 8 are then strategically connected a number of the floating devices 4 used to for the inner boundary structure 5 at locations where the anchor devices 8 hold the inner boundary structure stationary 5 in its desired location, even as the remote controlled boats 1 create wakes which would relocate an un-anchored inner boundary structure 5 within the large tank structure 3. By interconnecting the floating structures 4, the inner boundary structure 5 can be anchored by using minimal anchor devices 8, whereas, had the floating devices 4 not been interconnected, each individual floating device 4 would require is own anchor device 8.

As shown in FIGS. 5, 6, & 7, there are a number of configurations which the floating devices 4 and anchor devices 8 can be arranged into within the confines of a large tank structure 3 to create various shaped race courses. Additionally, because the floating devices 4 can be simply connected and disconnected from each other using the attachment members 7 discussed, users can simply and quickly convert the race courses into an multitude of different configurations, and the configurations depicted in FIGS. 5, 6, & 7 only intended to depict the versatility of the device, and not limit the scope of the invention.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. A method for constructing a race track for remote control boats comprising;

providing a tank filled with water filled to a level, said tank having sidewalls and a bottom;

providing a plurality of floating devices, said floating devices each comprising a three dimensional floating structure with a bottom, sides, and a top and at least one attachment member located on each floating device;

said attachment member capable of being connected to a mating attachment member on a separate floating device when the two attachment members contact each other;

providing at least one anchor device comprising a weight and a tether wherein an upper end of a tether is connected to the bottom of the floating device and the lower end of the tether is connected to the weight;

providing a long pole structure to connect and disconnect the floating devices while outside the tank;

while outside the tank, arranging within the sidewalls of the tank the floating devices into inner boundary structures in an arrangement creating channels which remote control boats can travel through when racing using the long pole structure;

wherein, several floating devices can be connected together to form the inner boundary structures by the at least one attachment member provided on the floating devices;

wherein at least one anchor device is attached to the bottom of at least one of the floating devices used to form each of the inner boundary structures.

2. A remote control boat race course system comprising;

a race course outer boundary comprising a large tank structure filled with water to a depth, said tank structure having sidewalls and a bottom;

at least one race course inner boundary comprised of a plurality floating devices arranged to create channels which remote control boats can travel through when racing;

a long pole structure to connect and disconnect the floating devices while outside the tank;

said floating devices each comprising at least one attachment member capable of being connected to a mating attachment member on a separate floating device when the two attachment members contact each other;

said floating devices each comprising at least one anchoring attachment member for attaching an anchoring device to the floating device;

at least one anchoring device attached to at least one of the floating devices to fix the location of the at least one race course inner boundary within the race course outer boundary;

said anchoring device comprising a tether with an effective length extending from the at least one anchoring attachment member for attaching to the floating device to the bottom of the tank structure;

said tether comprising an upper end connectable to said at least one anchoring attachment member for attaching the anchoring device to the floating device, a lower end with a weight attached, and a means for the tether length to self-adjust to varying water depths so the tether remains taut.

3. The remote control boat race course system of claim 2, said attachment member for connecting the floating device to other floating devices comprises magnets.

4. The remote control boat race course system of claim 2, said attachment member for connecting the floating device to other floating devices comprises a hook and loop fastener.

5. The remote control boat race course system of claim 2, said means for the tether length to self-adjust to varying water depths comprises a barbell device with at least on flat side where the upper end of the tether is connected to an underside of the floating device and a lower end of the tether is attached to the barbell and the tether is wrapped around the barbell so that the tether unwinds from the barbell as the barbell sinks to the bottom of the tank structure until the tether reaches its effective length.

6. The remote control boat race course system of claim 2, said means for the tether length to self-adjust to varying water depths comprises a spool and reel connected to an underside of a floating device where an upper end of the tether is attached to the spool and a weight is attached to a lower end of the tether so that the tether unwinds from the spool as the weight sinks to the bottom of the tank structure until the tether reaches its effective length.

7. The remote control boat race course system of claim 2, said means for the tether length to self-adjust to varying water depths comprises an elastic tether connected to an underside of the floating device where an upper end of the tether is attached to the floating device and a weight is attached to a lower end of the tether and the elastic tether expands until the tether reaches its effective length.

* * * * *